US007520643B2

(12) United States Patent
Caferro

(10) Patent No.: US 7,520,643 B2
(45) Date of Patent: Apr. 21, 2009

(54) LIGHTING LOUVER SYSTEM

(75) Inventor: Edward N. Caferro, Spokane, WA (US)

(73) Assignee: Ecolite Manufacturing Company, Inc., Spokane, WA (US)

( * ) Notice: Subject to any disclaimer, the term of this patent is extended or adjusted under 35 U.S.C. 154(b) by 0 days.

(21) Appl. No.: 11/018,397

(22) Filed: Dec. 20, 2004

(65) Prior Publication Data

US 2006/0133088 A1 Jun. 22, 2006

(51) Int. Cl.
*F21V 7/00* (2006.01)

(52) U.S. Cl. ..... 362/342; 362/354; 362/325

(58) Field of Classification Search ..... 362/279, 362/290, 342, 325, 354, 297; 29/428; 220/509, 220/510, 515
See application file for complete search history.

(56) References Cited

U.S. PATENT DOCUMENTS 3,021,778 A * 2/1962 Slatkovski ..... 454/280
3,033,979 A * 5/1962 Cahill ..... 362/354
3,391,629 A * 7/1968 Snell ..... 454/290
3,544,787 A * 12/1970 Audeval ..... 362/354
3,969,870 A * 7/1976 Deaton ..... 52/645
4,268,897 A * 5/1981 Schierwagen et al. ..... 362/325
5,008,791 A * 4/1991 Caferro ..... 362/290
5,335,156 A 8/1994 Caferro
5,806,972 A * 9/1998 Kaiser et al. ..... 362/290
6,238,064 B1 5/2001 Caferro
6,582,098 B1 * 6/2003 Brown et al. ..... 362/291
6,626,560 B1 * 9/2003 Caferro et al. ..... 362/290
6,705,747 B2 * 3/2004 Caferro et al. ..... 362/291

* cited by examiner

*Primary Examiner*—Jong-Suk (James) Lee
*Assistant Examiner*—Robert May
(74) *Attorney, Agent, or Firm*—Wells St. John P.S.

(57) ABSTRACT

A system for making and providing a grid or louver system preferably for application in the lighting industry, wherein a single and substantially flat workpiece is cut or stamped from a blank to facilitate bending of portions thereof and the interlocking or intermeshing of it with a second workpiece which may be made in substantially the same or the same way.

6 Claims, 12 Drawing Sheets

LIGHTING LOUVER SYSTEM

TECHNICAL FIELD

This invention pertains to a grid or louver apparatus, and methods of making such system, with primary application to the lighting industry.

BACKGROUND OF THE INVENTION

Most of those acquainted with lighting louvers are familiar with rectangular arrays of reflectors used in ceiling mount or suspended installations. Such mounts are very common, especially for use with florescent lights. It is known to use parabolic reflectors or curved reflectors in such louver construction for desired illumination characteristics, although such a configuration is not required.

The manufacture of lighting louvers with multiple parallel and perpendicular components or elements (longitudinal and transverse) has heretofore involved the manufacture of numerous individual components (depending on the specific louver configuration), and then the assembly and pressing of the several components together to form a grid. The individual components may generally be placed into an alignment or assembly framework or jig and then pressed or otherwise placed together for the final product.

It is believed that efficiencies may be achieved in the manufacture of such grids, frameworks or louvers if the number of individual components or elements is reduced, and if the number of manufacturing steps is reduced.

It is therefore an object of some embodiments of this invention to provide a method of manufacture and an end product wherein fewer components are assembled to achieve the desired louver, or fewer steps are required.

Other objects, features, and advantages of this invention will appear from the specification, claims, and accompanying drawings which form a part hereof. In carrying out the objects of this invention, it is to be understood that its essential features are susceptible to change in design and structural arrangement, with only one practical, and preferred embodiment being illustrated in the accompanying drawings, as required.

BRIEF DESCRIPTION OF THE DRAWINGS

Preferred embodiments of the invention are described below with reference to the following accompanying drawings.

FIG. 4 is a perspective view of one embodiment an exemplary grid component framework or array aligned by the assembly of a first grid component (longitudinal) framework to a second grid component (transverse) framework;

FIG. 14 is a perspective view of the embodiment of the transverse light louver component shown in FIG. 12;

DETAILED DESCRIPTION OF THE PREFERRED EMBODIMENTS

Fasteners, materials, drive mechanisms, control circuitry, manufacturing and other means and components utilized to make and implement this invention are known and used in the field of the invention described, and their exact nature or type is not necessary for an understanding and use of the invention by a person skilled in the art or science; therefore, they will not be discussed in significant detail. Furthermore, the various components shown or described herein for any specific application of this invention can be varied or altered as anticipated by this invention and the practice of a specific application or embodiment of any element may already be widely known or used in the art or by persons skilled in the art or science; therefore, each will not be discussed in significant detail.

The terms "a", "an", and "the" as used in the claims herein are used in conformance with long-standing claim drafting practice and not in a limiting way. Unless specifically set forth herein, the terms "a", "an", and "the" are not limited to one of such elements, but instead mean "at least one".

Lighting louver systems of numerous configurations and types have been in use for many years, and examples of such systems are: U.S. Pat. No. 6,626,560, issued to Caferro; U.S. Pat. No. 6,705,747, issued to Caferro, U.S. Pat. No. 5,335,156, issued to Caferro and U.S. Pat. No. 6,238,064, issued to Caferro; and all four of which are hereby incorporated by this reference into this application as though fully set forth herein.

It will be appreciated by those of ordinary skill in the art that while this invention is directed to applications in lighting, lighting grids and lighting louvers, the invention is not limited to that and may be used in other industries and applications.

Figure 1:
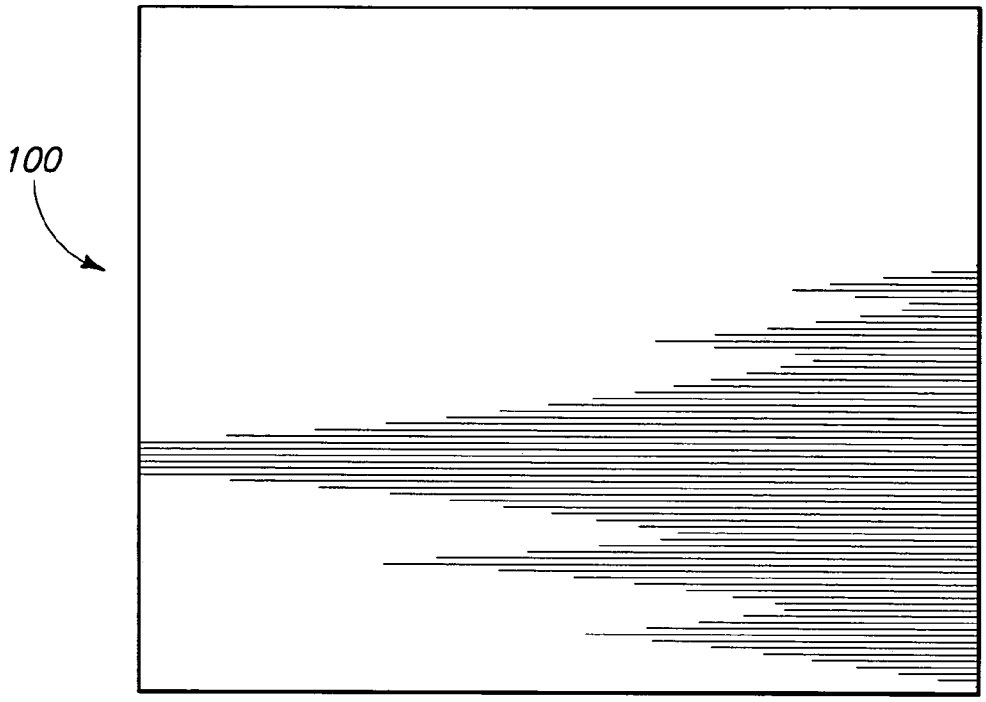
FIG. 1 is a top view of an exemplary component blank from which one of the longitudinal or transverse grid components or louver components may be manufactured.

FIG. 1 is a top view of an exemplary grid component blank 100 from which one of the longitudinal or transverse grid or louver components may be manufactured. It will be appreciated by those of ordinary skill in the art, that no particular material, size or configuration is required for the component blank 100, but instead it would depend upon the particular application. For lighting louvers it may be one material, for lighting grids another material, and any one of a different number of alternate materials may be design choices, such as metallic or semi-metallic material, all within the contemplation of this invention and all which are known in the art.

Figure 5:
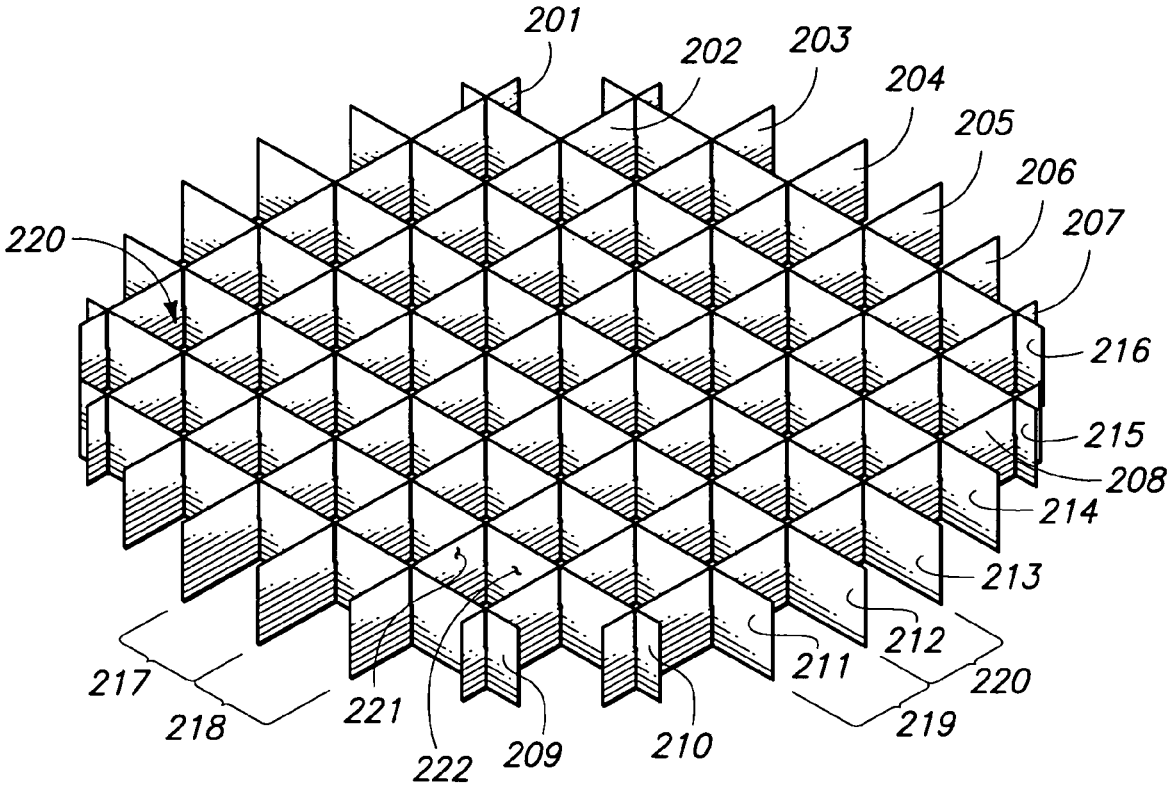
FIG. 5 is a perspective view of an embodiment of an assembled or integrated grid, wherein the outer portion or framework has been trimmed to achieve a desired shape.

While the embodiment of the component blank shown is approximately square, it need not be; and further, the blank may have areas around the perimeter that are trimmed to make the resulting part something other than square, such as circular, elliptical, or rectangular, depending on what is trimmed off at or towards the end of the process. One example of this is shown in FIG. 5.

It will also be appreciated by those of ordinary skill in the art that the blank shown in FIG. 1 from the top view generally defines an x-y plane, with the thickness being the z plane or z dimension. After the blank is cut or stamped (as shown and described with respect to later figures), and then bent, the z dimension of the component is substantially different.

Figure 2:
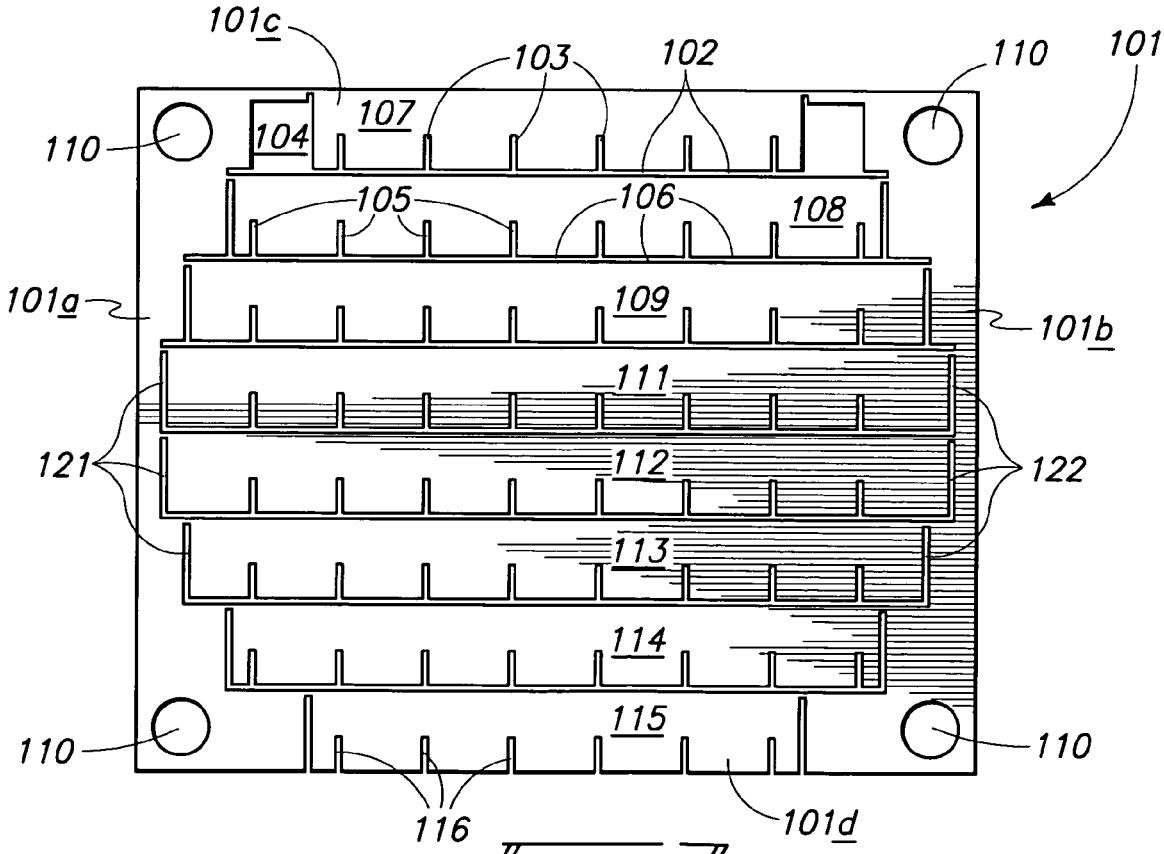
FIG. 2 is a top view of one embodiment of a cut or stamped grid component blank with the cut pattern imposed thereon defining a plurality of longitudinal grids or grid components, and further defining a plurality of transverse grid component receiving areas on the longitudinal grid components.

FIG. 2 is a top view of an exemplary grid component blank with a cut pattern imposed thereon, the cut pattern defining a plurality of longitudinal grid components and a plurality of transverse grid component receiving areas on the longitudinal grid components. The cut pattern imposed on the component blank may be imposed by any one of a number of different types of methods, included in stamping, laser cutting or others known or used in the industry, with no one in particular being required to practice the invention.

FIG. 2 illustrates a longitudinal cut component blank 101, which may also be referred to as a workpiece or cut workpiece, with the cuttings defining a plurality of longitudinal grid components 107, 108, 109, 111, 112, 113, 114 and 115; and the plurality of transverse grid component receiving areas exemplified by items 103, 105 and 116, although there are many others shown. The transverse grid component receiving areas 103, 105 and 116 are configured to interact with engage, and receive a corresponding grid component from a longitudinal cut component blank to for the end product such as a grid or louver. The longitudinal cut component blank 101, has first side 101*a*, second side 101*b*, third side 101*c* and fourth side 101*d*, with apertures 110.

FIG. 2 further illustrates longitudinal cuts 102 and 106 which define one side of grid components. FIG. 2 further illustrates longitudinal grid component end cuts 121 and 122, which provide the end cuts defining the outer boundaries of the plurality of longitudinal grid components. Only a few exemplary end cuts (there are several others in the embodiment of the invention illustrated in FIG. 2), are discussed in an exemplary way as those skilled in the art will understand the nature, extent and use thereof in embodiments of this invention.

Figure 3:
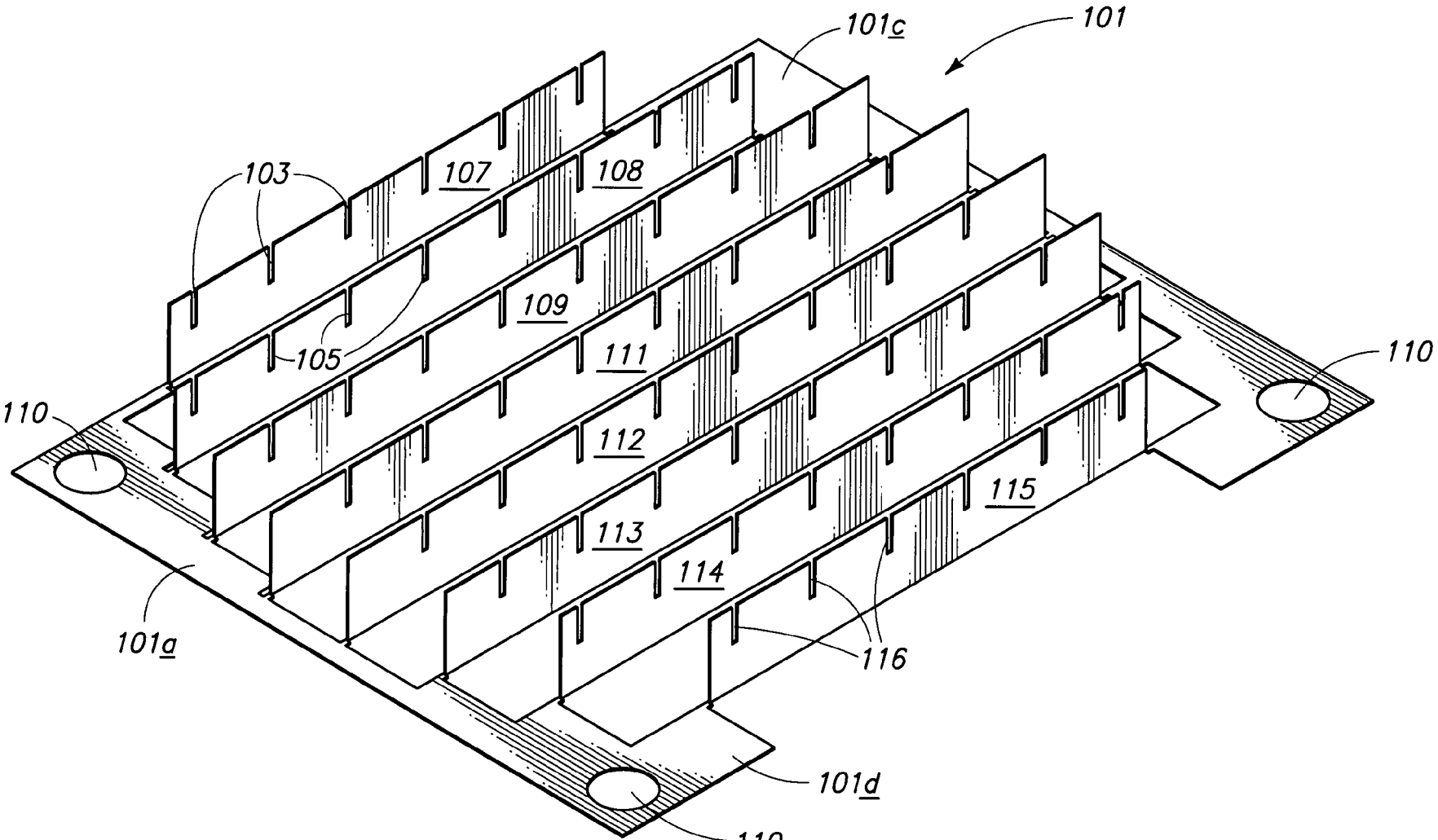
FIG. 3 is a perspective view of the embodiment of the grid component blank shown in FIG. 2, wherein the plurality of longitudinal grid components have been bent to an approximately perpendicular orientation relative to the first grid component framework.
Figure 3:
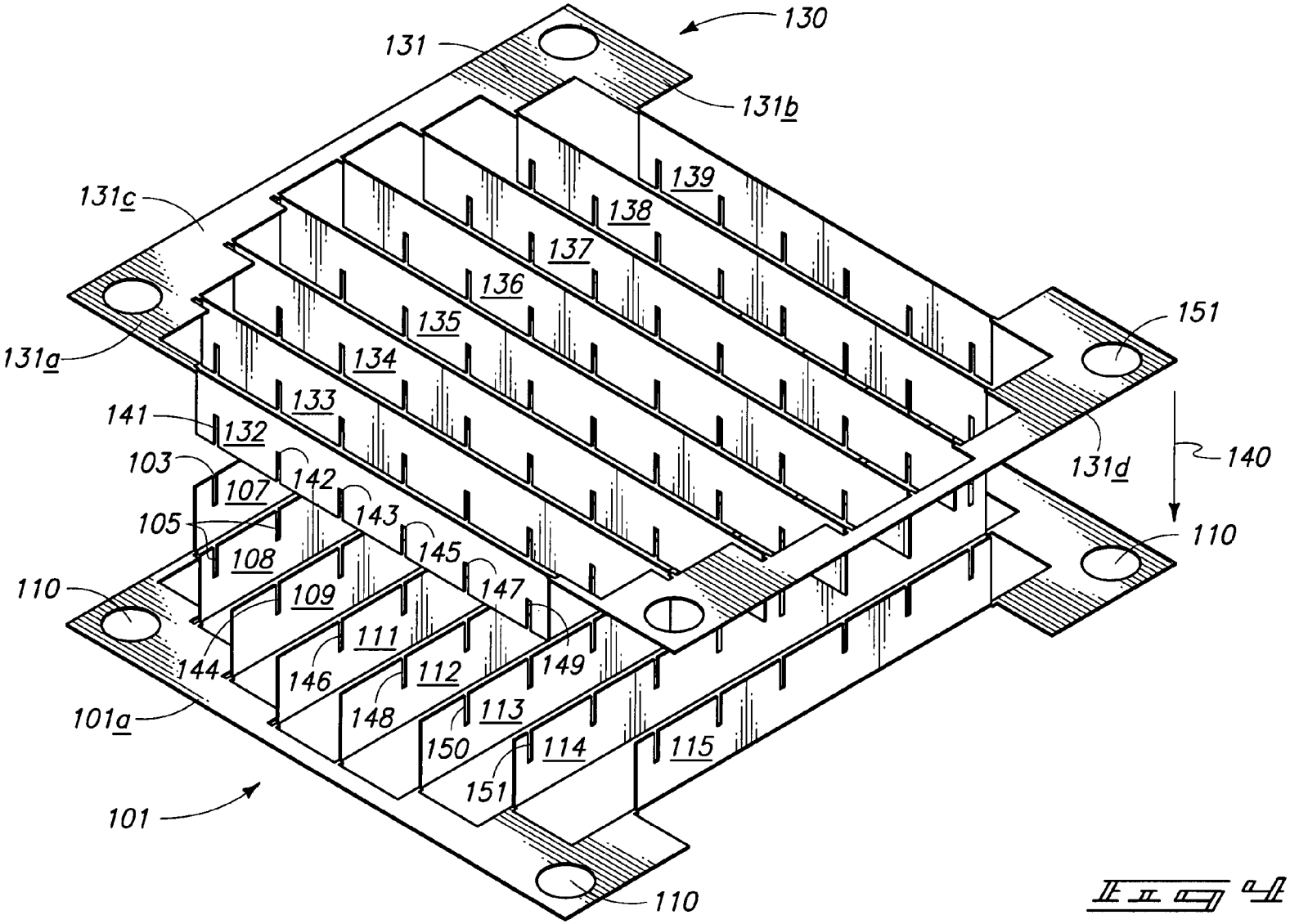

FIG. 3 is a perspective view of the exemplary grid component blank shown in FIG. 2, wherein the plurality of longitudinal grid components 107, 108, 109, 111, 112, 113, 114 and 115, have been bent to an approximately perpendicular relation to the orientation of the grid component blank or framework portion (which would in part include the portion identified as item 101*d* and 101*a*. FIG. 3 illustrates longitudinal cut component blank framework, after the plurality of longitudinal grid components have been bent to approximately 90 degrees from their position as shown in FIG. 2. The item numbers shown in FIG. 3 are the same for the items shown in FIG. 2 and will not be repeated here with respect to FIG. 3.

By bending the longitudinal grid components, the plurality of transverse grid component receiving areas 103, 105 and 116 are substantially positioned to receive and interact with transverse grid components.

It will also be appreciated by those of ordinary skill in the art, that the bending process of the plurality of longitudinal grid components may be accomplished in one or more steps, all within the contemplation of this invention and with no one in particular being required to practice this invention. It will also be appreciated that there are no dimensions, configurations or number of longitudinal grid components required to practice this invention, as that would go towards a specific application of an embodiment of this invention. There are many aspects of this invention and it may be applied in many different ways.

FIG. 4 is a perspective view of an exemplary grid component framework aligned for the assembly of a first grid component framework to a second grid component framework. FIG. 4 illustrates a first louver component 101 and a second louver component 130. The first louver component 101 is the same from the longitudinal cut component blank, as bent and as shown in FIG. 3. The second louver component 130 may be similarly constructed or made from a one piece component blank, only the individual louver components are referred to as transverse since they are configured in a direction approximately perpendicular to the longitudinal components. The plurality of transverse louver components 132, 133, 134, 135, 136, 137, 138 and 139 have been bent in substantially the same way as described herein with respect to the longitudinal cut component blanks.

The plurality of transverse louver components 132, 133, 134, 135, 136, 137, 138 and 139 on the second louver component each include a plurality of longitudinal grid component receiving areas 141, 142, 143, 145, 147 and 149, which are configured to intermesh or interlock with the longitudinal grid components on the first louver component 101, and the plurality of transverse louver component receiving areas 103, 105, 144, 146, 148, 150 and 151, shown on the first louver component. The first louver component may also be referred to as the longitudinal grid component, or visa-versa.

FIG. 4 further illustrates second louver component body 131 with first side 131*a*, second side 131*b*, third side 131*c* and fourth side 131*d*.

In one of many aspects of this invention, a one piece first louver component, which includes a plurality of longitudinal grid components connected to and bent approximately perpendicular to a common framework, may be utilized, wherein each of the plurality of longitudinal grid components includes a plurality of transverse grid component receiving areas configured to receive a plurality of transverse grid components.

It will be appreciated by those of ordinary skill in the art, that a second corresponding one-piece louver component may be constructed and connected to the first louver component, or that one or more individual transverse grid components may be inserted into the plurality of transverse grid component receiving areas to assemble and manufacture the lighting louver or other component. This would not have as much benefit as other embodiments of this invention, but some may be achieved, or it may be desirable for other reasons.

In some aspects of this invention, it is preferred that the second louver component would be comprised of a plurality of transverse grid components connected to and bent at approximately perpendicular to a common framework, with each of the plurality of transverse grid components including a plurality of longitudinal grid component receiving areas which are configured to receive the plurality of longitudinal grid components from the first louver component.

It will also be appreciated that once the louver, grid or other device is fully assembled and the transverse components are attached or secured to the longitudinal components, the framework or remaining material which interconnects, holds or retains the respective grid components, may be removed. Once removed, it may be very difficult to determine the process by which the product was assembled or made.

It will also be appreciated by those of ordinary skill in the art, that no particular application is required to practice this invention, and therefore, individual, grid components may be louver-like, curved, parabolic, or straight, as shown in FIG. 3, for example.

FIG. 5 is a perspective view of an assembled integrated grid with the outer portion trimmed to achieve a desired shape. The assembled integrated grid illustrated in FIG. 5 was assembled from a first grid or louver component and a second grid or louver component, wherein the respective frameworks which were present after bending of the individual components, has been removed, leaving only the grid, as shown.

FIG. 5 shows longitudinal grid components 209, 210, 211, 212, 213, 214, 215 and 216, and transverse grid components 201, 202, 203, 204, 205, 206, 207 and 208. The respective transverse grid components and longitudinal grid components are operatively attached to one another and form an integrated grid or unit with a plurality of individual cells 220. As an exemplary cell, longitudinal grid component 210 has surface 222 and transverse grid component 206 includes surface 221, which are two surfaces to form one of the plurality of cells.

FIG. 5 also illustrates first distance 217 and second distance 218 between respective transverse grid components, as shown. It will be appreciated by those of ordinary skill in the art, that neither the transverse grid components nor the longitudinal grid components need be equally spaced from one another, although they may be, depending on the application and the desired effect of the grid. FIG. 5 further illustrates first longitudinal distance 219 and second longitudinal distance 220 between respective longitudinal grid components.

Those of ordinary skill in the art will appreciate that once the grid is formed and the framework removed, as shown in FIG. 5, it will be difficult in some embodiments of the invention to determine by the eye if the end product was constructed by methods disclosed by this invention or by prior art methods.

Figure 6:
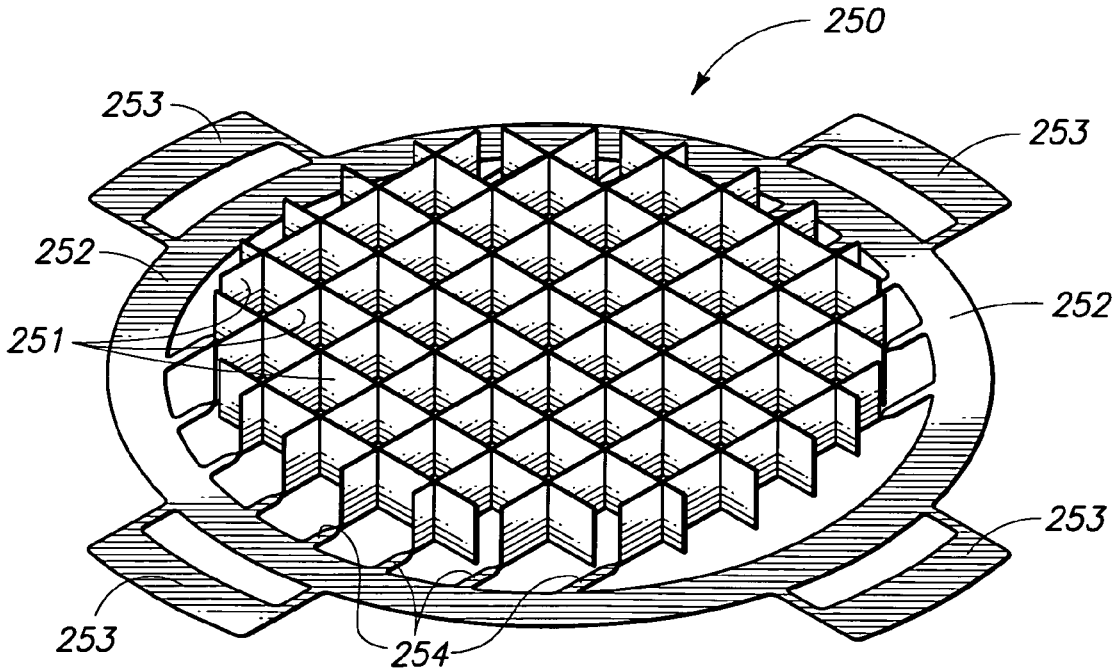
FIG. 6 is a perspective view of an embodiment of an assembled integrated grid wherein the outer portion or framework includes mounting tabs and a mounting surface to facilitate the operative attachment to an object such as a light housing.

FIG. 6 is a perspective view of an embodiment of an assembled integrated grid with the outer portion including tabs and a mounting surface for attachment to an object. FIG. 6 illustrates an aspect of this invention wherein the framework of either or both of the first louver component or the second louver component may be utilized as a framework to attach the lighting louver or lighting grid to some other object, such as a light housing. FIG. 6 illustrates an assembled light housing grid 250 with framework 252 and a plurality of tabs 253, which are part of the framework. The grid components 251 are attached to framework 252 via tabs 254, and substantially fix the grid to the framework.

It will be appreciated by, those of ordinary skill in the art that the plurality of attachment tabs 253 may be secured directly to the integrated grid instead of to an intermediate framework, within the scope of and contemplation of this invention.

Figure 7:
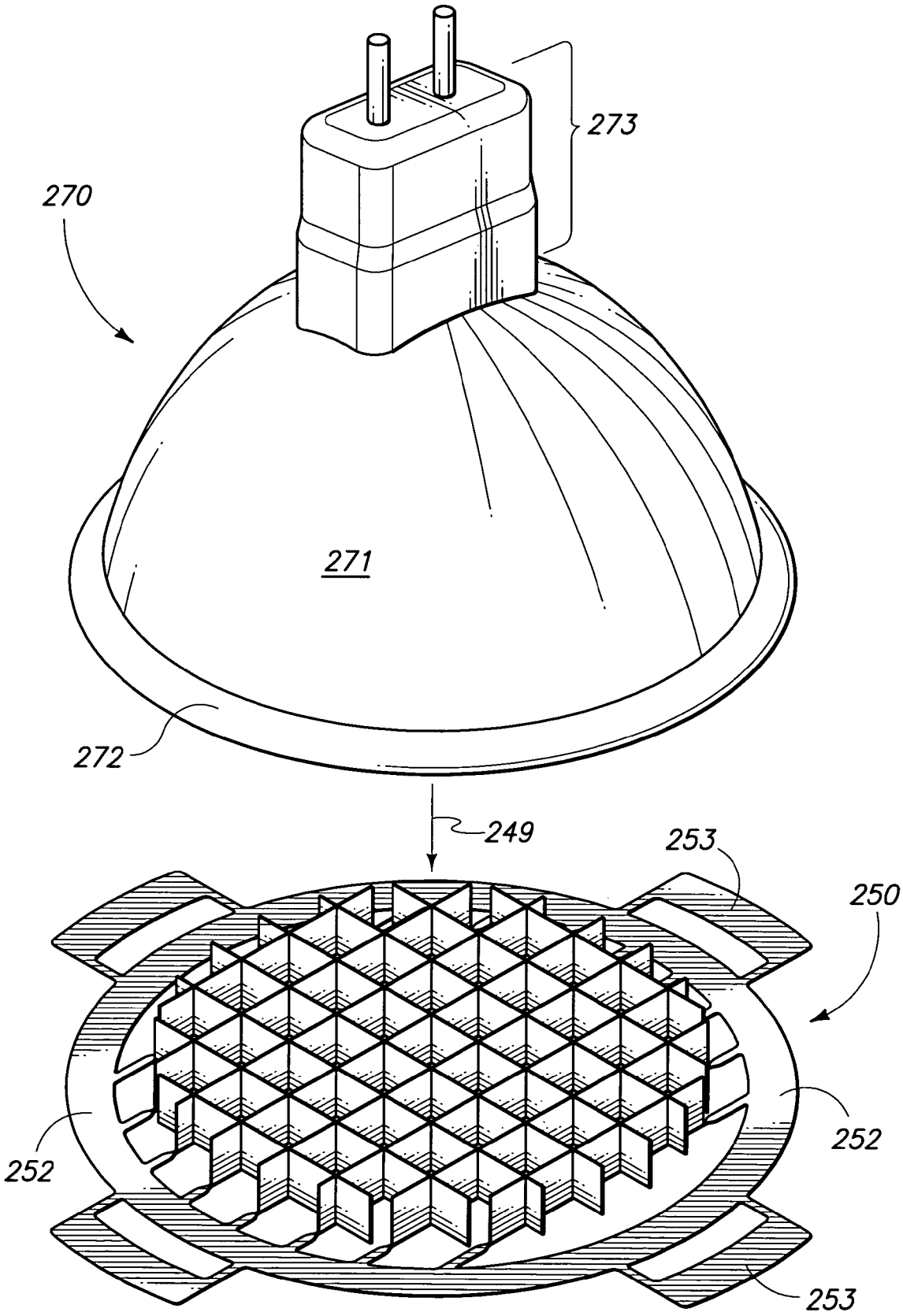
FIG. 7 is a perspective exploded view of the embodiment of the invention shown in FIG. 6, positioned relative to an object, which is a light housing in this embodiment.
Figure 8:
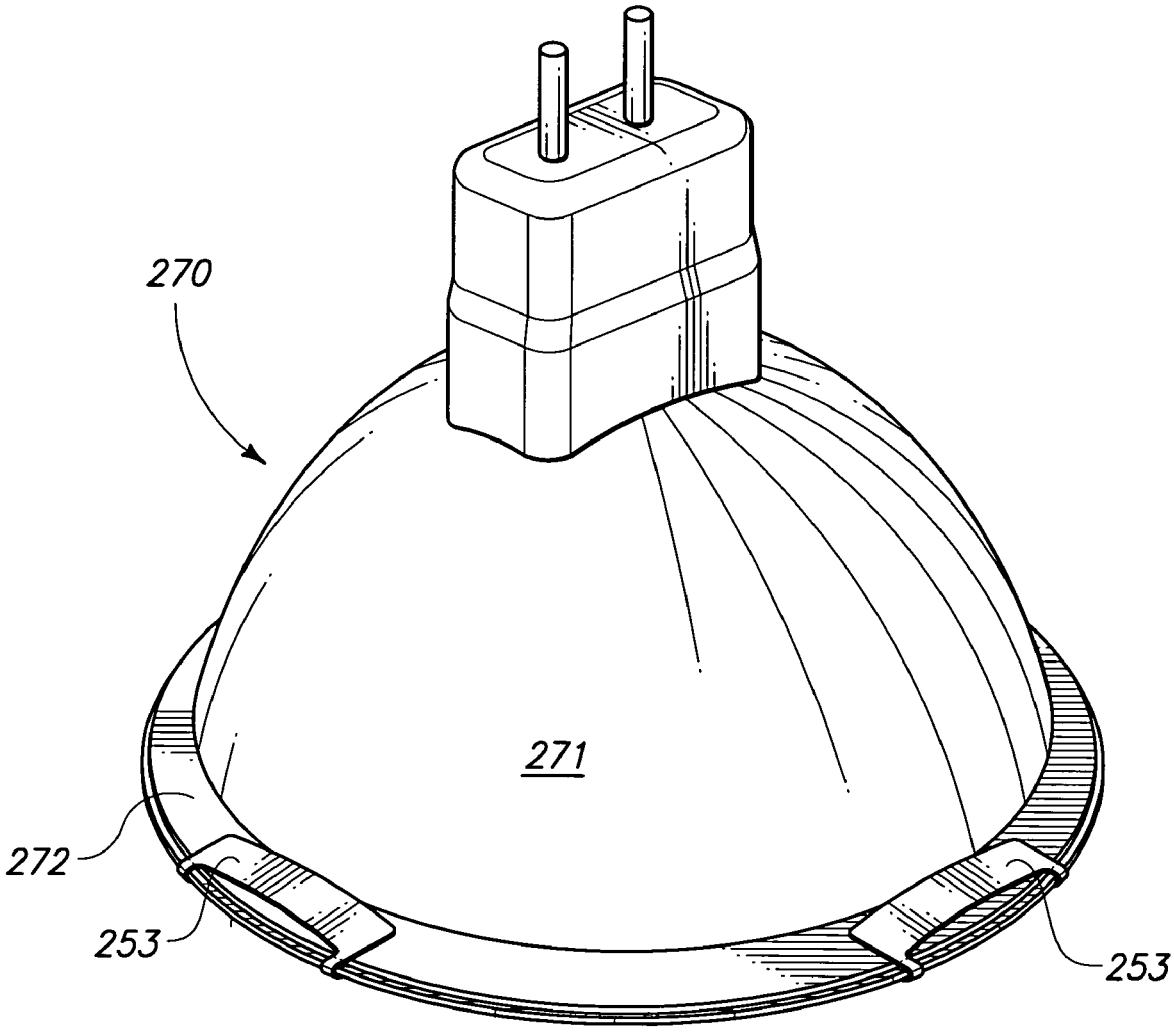
FIG. 8 is a perspective and assembled view from the exploded view shown in FIG. 7.

FIG. 7 is a perspective exploded view of the assembled integrated grid 250 shown in FIG. 6 positioned relative to an object which is a light housing in this embodiment. FIG. 7 illustrates the assembled integrated grid 250 from FIG. 6, relative to a light fixture 270 with light housing 271 and lip 272. Electrical component and connector component 273 provides the operable portions for the light. Arrow 249 indicates that light housing 271 may be moved down toward and onto framework 252, and as shown in FIG. 8, tabs 253 may then be bent around housing lip 272 on light housing 271 to attach the lighting grid to the lighting fixture 270. The like numbered items from prior figures refer to the same items, aspects and components, and will not therefore be repeated here.

FIG. 8 is a perspective and assembled view from the exploded view shown in FIG. 7. The like numbered items from prior figures will not be repeated here.

While the embodiments or aspects of the invention illustrated in prior figures show more of a lighting grid or cover with straight edges in the cells or apertures, it would be appreciated by those of ordinary skill in the art that other configurations for the longitudinal and transverse grid components may be constructed using aspects or methods disclosed by this invention. For example, curved, parabolic or other orientations of grid components may be utilized to make lighting fixtures, lighting louvers and other products.

Figure 9:
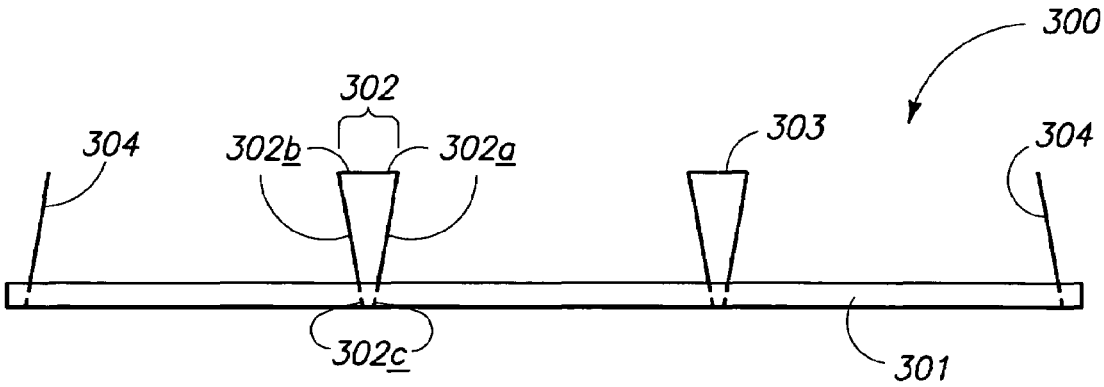
FIG. 9 is a front view of one example of an embodiment of a longitudinal light louver component or grid component, which may be utilized in this invention.

FIGS. 9 though 16 illustrate a lighting louver grid embodiment of this invention, as more fully discussed below.

FIG. 9 is a front view of one example of an embodiment of a longitudinal light louver component or grid component, which may be utilized in this invention. FIG. 9 illustrates a longitudinal light louver component 300 with framework 301, first louver 302 and second louver 303. Each louver is formed by bending from a flat or substantially flat sheet with first side 302*a* being bent twice and second side 302*b* likewise being bent twice to form the desired shape of the louver. It will be appreciated by those of ordinary skill in the art, that any one of a number of different shapes may be utilized, all within the scope of this invention. Each end of the configuration or embodiment shown in this figure includes an end louver 304, as desired for the end product.

Figure 10:
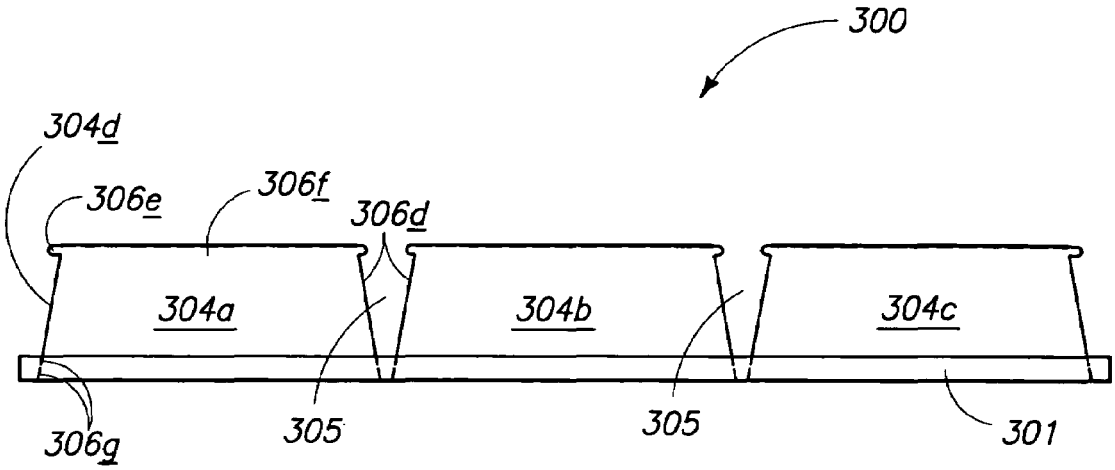
FIG. 10 is a side view of the longitudinal light louver component shown in FIG. 9.

FIG. 10 is a side view of the longitudinal light louver component shown in FIG. 9. FIG. 10 illustrates that end louver 304 may be broken or split into two or more sections, in this case three sections, namely, first louver part 304*a*, second louver part 304*b* and third louver part 304*c*. Each of the louver parts have a receiving area to receive a transverse louver between respective louver parts, with receiving area 305 identifying where the transverse light louver component would be received. Each of the louvers are attached to framework 301.

Figure 11:
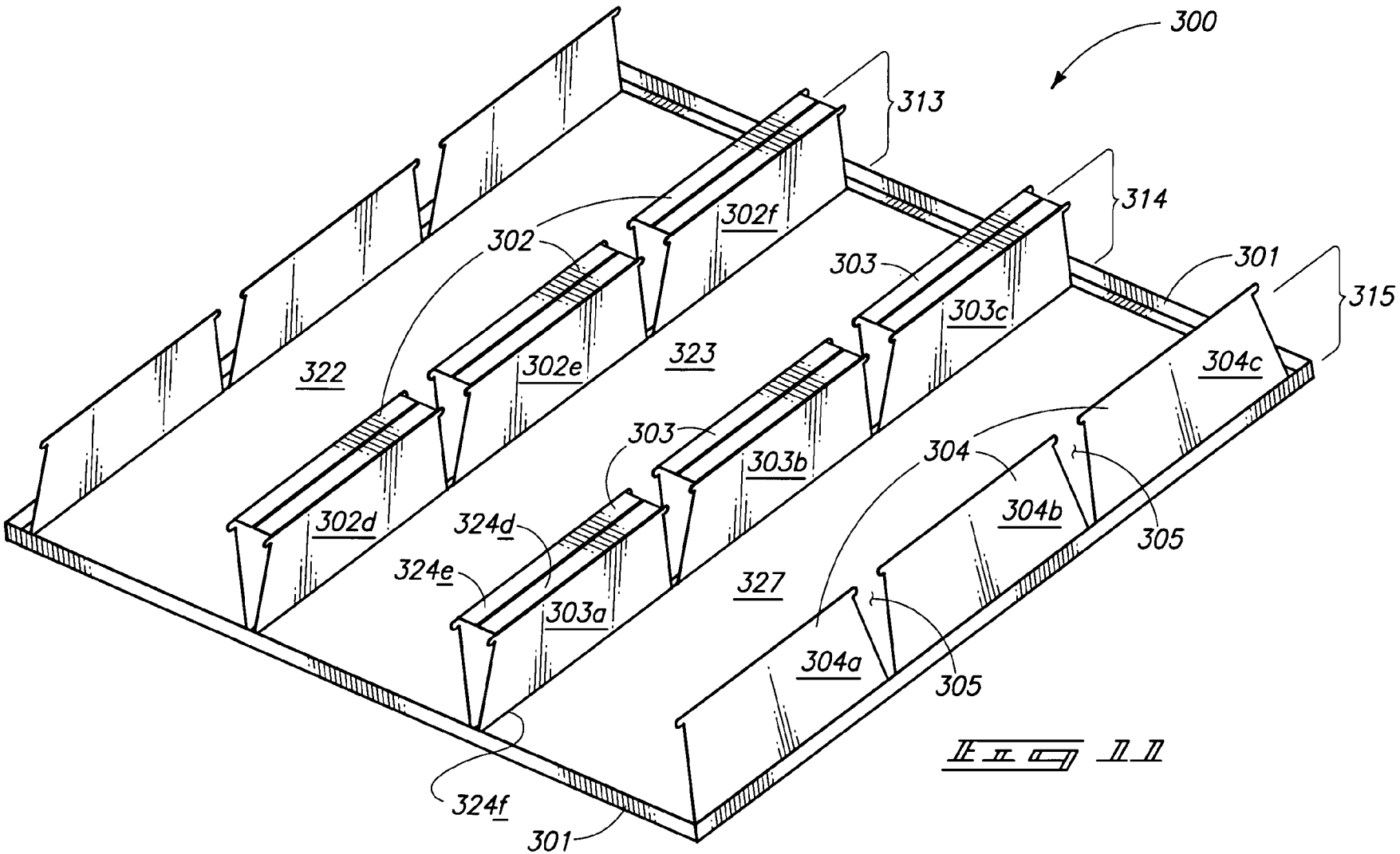
FIG. 11 is a perspective view of the embodiment of the longitudinal light louver component shown in FIG. 9.

FIG. 11 is a perspective view of the embodiment of the longitudinal light louver component shown in FIG. 9. FIG. 11 illustrates longitudinal end louver 304, longitudinal louver 303 and longitudinal louver 302, each having a first part, a second part and a third part with transverse louver receiving areas 305 between the respective parts of the louver. For example, louver 304 has first louver part 304*a*, second louver part 304*b* and third louver part 304*c*, with a height 315 and with transverse louver receiving areas 305 between the respective louver parts. Louver 303 is shown with first louver part 303*a*, second louver part 303*b* and third louver part 303*c*, and first side 324*d*, second side 324*e* and bottom side 324*f* corresponding to the parts bent to achieve the louver configuration.

The framework 301 is attached to each of the louvers and holds them in place and after the louvers are bent as shown, there is first space 327, second space 323 and third space 322 between the respective louvers on the framework 301.

When louvers are generally configured from flat sheet and initially cut or stamped to provide areas which facilitate bending, and then bent as shown in FIG. 11, they can easily be slipped together with transverse louver configuration, and the resulting manufacturing process with two components or work pieces versus eight or more, greatly reduces and simplifies the manufacturing process. Louver 302 has height 313 and louver 303 has height 314.

Figure 12:
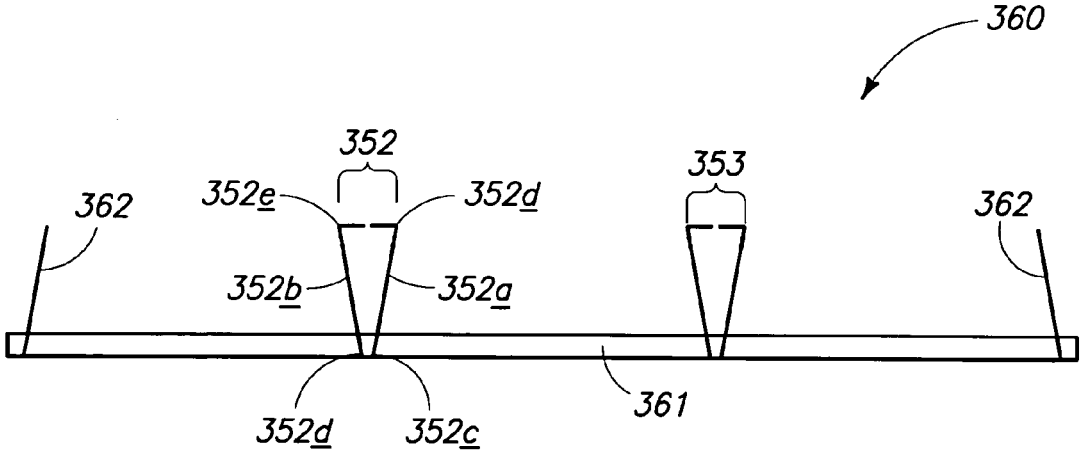
FIG. 12 is a front view of one example of an embodiment of a transverse light louver component or grid component, which may be utilized in this invention.

FIG. 12 is a front view of one example of an embodiment of a transverse light louver component or grid component, which may be utilized in this invention. FIG. 12 illustrates framework 361, transverse end louver 362, transverse louver 353 and transverse louver 352. Transverse louver 352 illustrates a first section 352*a*, bend 352*d*, second section 352*b* and bend 352*e*. Louver 352 is bent about bend point 352*c* for first leg 352*a* and bent about 352*d* for second leg 352*b*.

Figure 13:
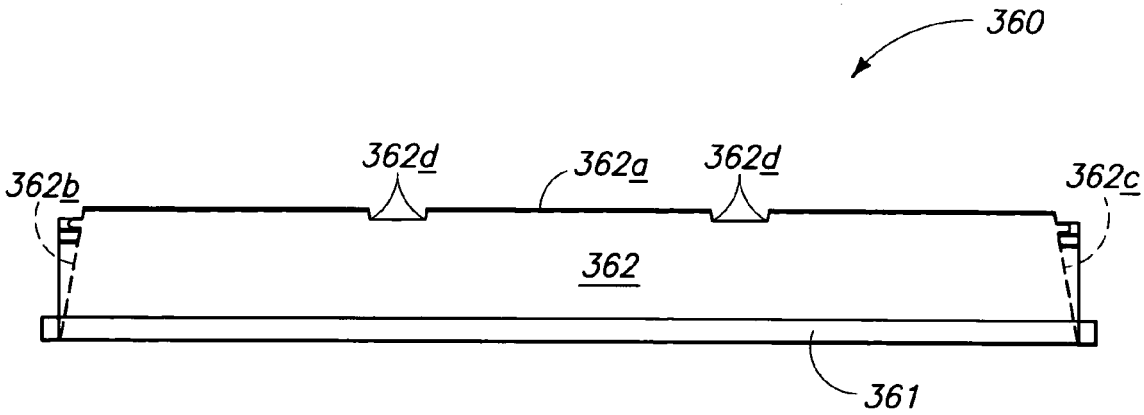
FIG. 13 is a side view of the transverse light louver component shown in FIG. 12.
Figure 11:
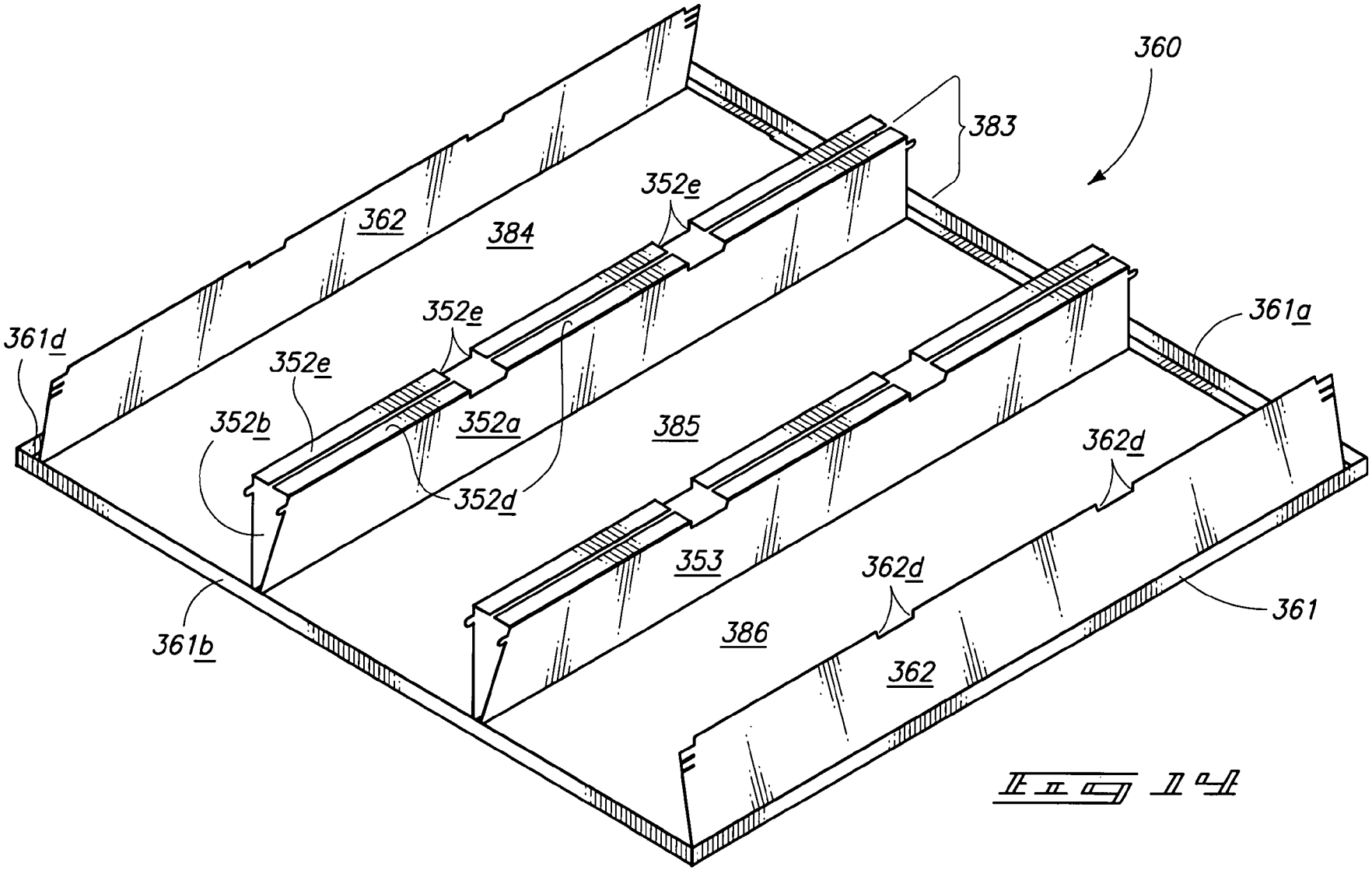

FIG. 13 is a side view of the transverse light louver component shown in FIG. 12. FIG. 13 illustrates an exemplary end louver 362 with first side 362*a*, first end 362*b* and second end 362*c*. There are two notches 362*d* in first end 362*a*, with the notches corresponding to the transverse receiving areas 305 in the longitudinal lighting louvers, as shown more fully in later figures.

FIG. 14 is a perspective view of the embodiment of the transverse light louver component shown in FIG. 12. FIG. 14 illustrates the transverse light louver component 360 with transverse end louvers 362, transverse louver 352 and transverse louver 353. After the transverse louvers are bent, this creates spaces 384, 385 and 386 between respective louvers. Otherwise, all items in FIG. 14 are described by like numbers in prior figures, and will not be further described herein.

It will be appreciated by those of ordinary skill in the art that the terms transverse and longitudinal are used to designate reference directions only and no particular angle between the two designations is required to practice this invention. For example there need not be an approximate ninety degree angle between the longitudinal and the transverse within the scope of this invention. Instead the angle between the two references of longitudinal and transverse may be any one or more of a number of angles, including varying angles within the same grid or matrix.

Figure 15:
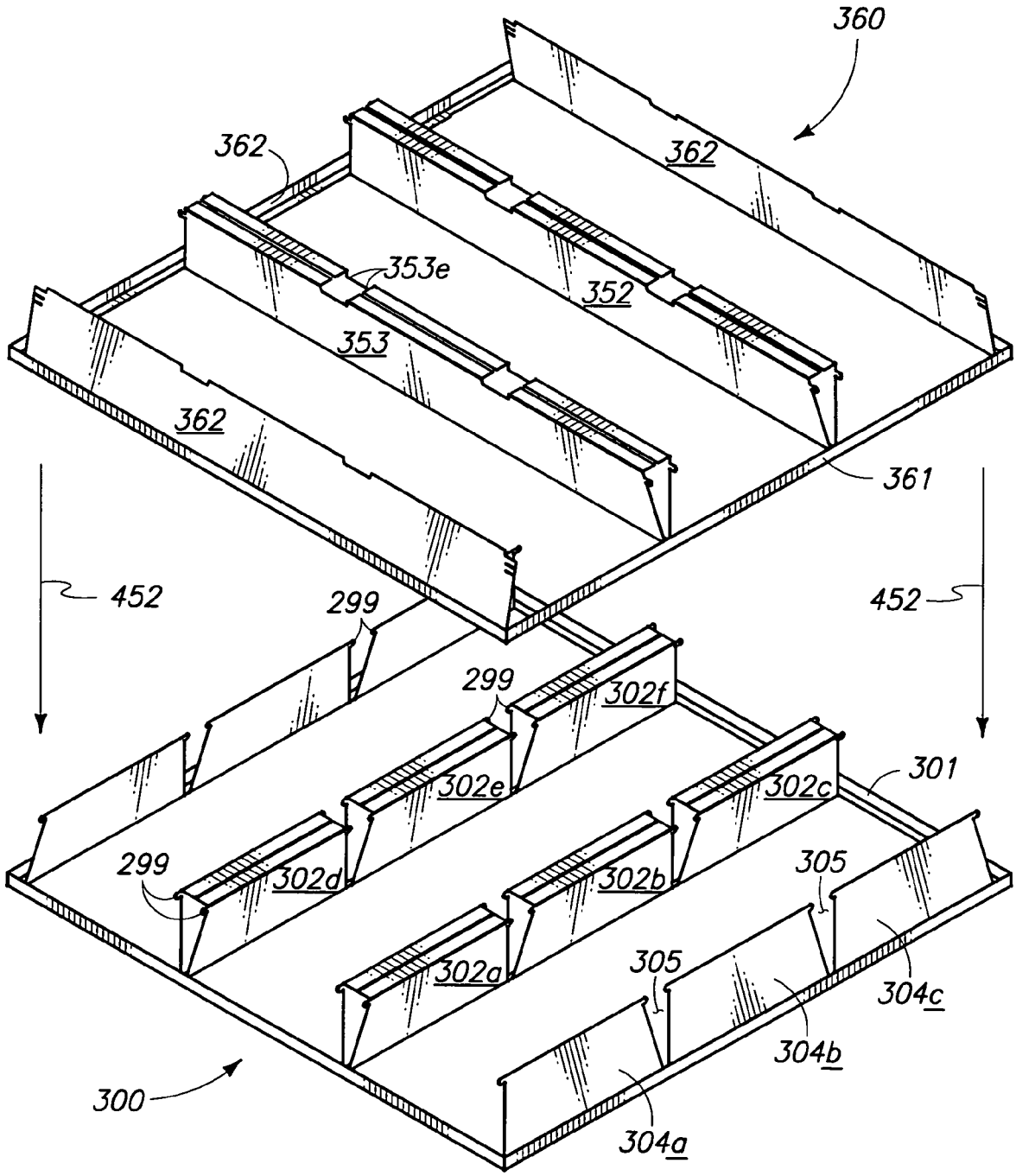
FIG. 15 is a perspective exploded view of the transverse light louver component relative to the longitudinal light louver component before being operatively attached together.

FIG. 15 is a perspective exploded view of the transverse light louver component relative to the longitudinal light louver component before being operatively attached together. This may also be referred to as a first louver workpiece and a second louver workpiece. FIG. 15 shows an exploded view with arrows 452 showing how transverse light louver 360 will be lowered and pressed onto and combined with longitudinal light louver 300 to form the light louver matrix illustrated in FIG. 16. Again, items shown in FIG. 15 are described and identified in prior figures and each will not be repeated herein.

Figure 16:
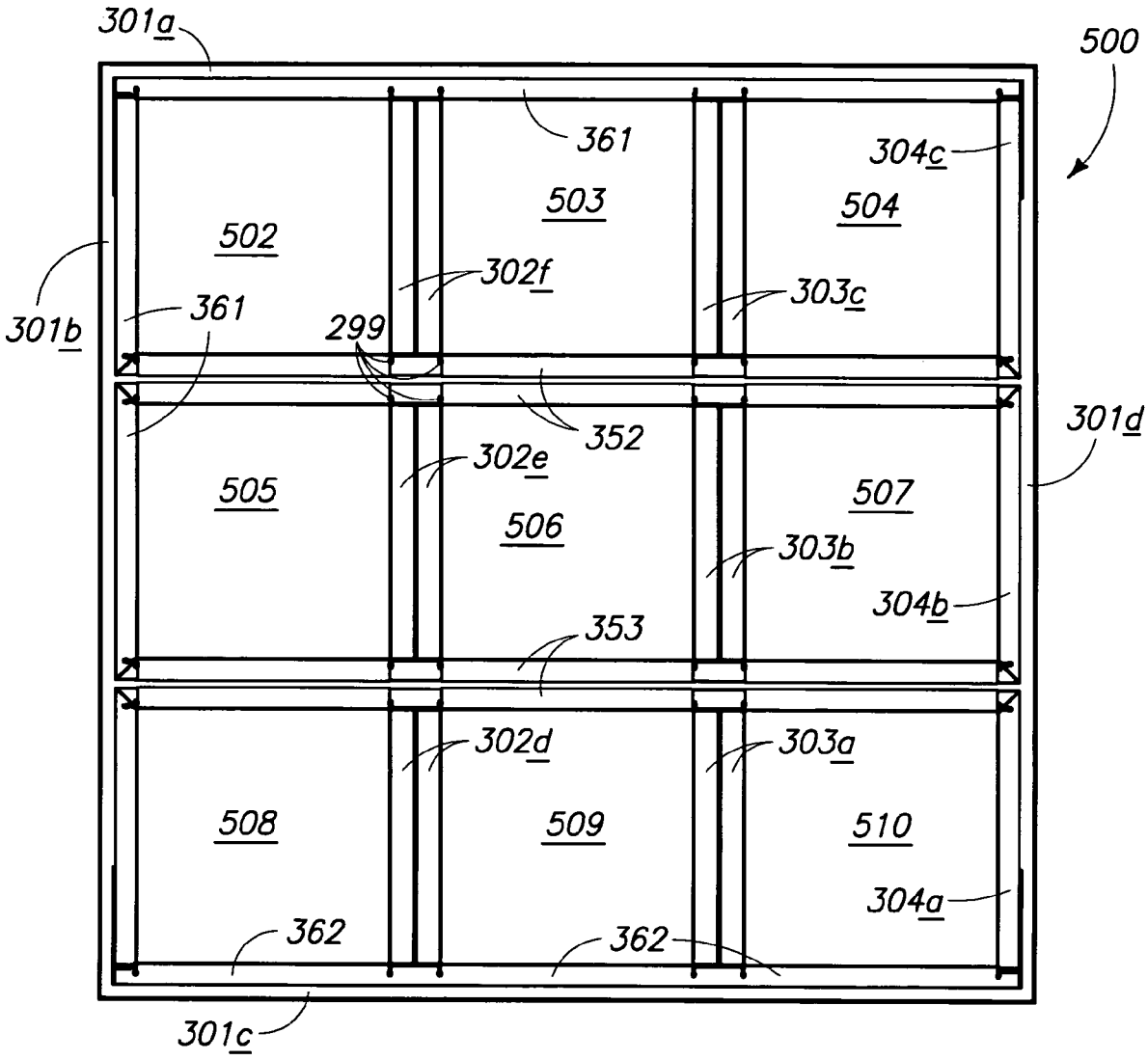
FIG. 16 is a top view of one example of an assembled light louver embodiment of the invention.

It will be appreciated by those of ordinary skill in the art that there may be numerous ways to achieve the level of operative attachment between a first louver component and a second louver component, and the same is true for grid components. In some cases merely pressing the two (or more) components together will achieve the desired level of attachment. In other cases, one may provide a plurality of tabs which somehow interlock with, hold or lock the first louver component and the second louver grids together. For example FIGS. 15 and 16 illustrate how two louver type component grids can be assembled together, and as can be seen in the drawings, there are tabs 299 (better illustrated on FIG. 15) on the sections of the longitudinal. The transverse louvers may have some flexibility such that they can be placed in the receiving areas and then once beyond the tabs 299 on the longitudinal louver sections, the tabs 299 may exclusively or in combination with other means (such as a tight fit) serve to hold the two components together.

FIG. 16 is a top view of one example of an assembled light louver embodiment of the invention, an array. FIG. 16 illustrates the nine cells 502-510 of the light louver matrix 500, resulting from the combination of the transverse light louver 360 and the longitudinal light louver 300 combined as shown in FIG. 15. The items labeled and identified by item numbers in FIG. 16 are those described and shown with respect to prior figures and will not be further described herein.

In one embodiment of the invention in a general sense, a component blank is the beginning workpiece, blank or stock, and the workpiece is cut or stamped with a pattern that facilitates bending of parts of the workpiece into a desired pattern which will result in the desired configuration of the final product. Once the cutting or stamping in the workpiece is accomplished (in one or more steps), then parts of the workpiece are bent a desired angle (which may be any one or more of a number of angles, depending on the desired final product). The workpiece is then ready for the operative attachment of it to one or more other workpieces. The framework may but need not be left attached to the grid or louvers (depending on the application) before the finished product or intermediate product is finished.

As will be appreciated by those of reasonable skill in the art, there are numerous embodiments to this invention, and variations of elements and components which may be used, all within the scope of this invention.

In one embodiment for example a method for assembling a lighting louver with a plurality of longitudinal and transverse louver components is provided, the method comprising: providing a first louver workpiece which includes a plurality of longitudinal louver components, each of the plurality of longitudinal louver components including a plurality of transverse louver component receiving areas; providing a second louver workpiece which includes a plurality of transverse louver components configured for insertion into the plurality of transverse louver component receiving areas; and operatively attaching the first louver workpiece to the second louver workpiece.

In another embodiment, a method for assembling a grid with a plurality of longitudinal and transverse components is provided, the method comprising: providing a first grid component which includes a plurality of longitudinal grid components, each of the plurality of longitudinal grid components including a plurality of transverse grid component receiving areas; providing a second grid component which includes a plurality of transverse grid components configured for insertion into the plurality of transverse grid component receiving areas; inserting the plurality of transverse grid components on the second grid component into the plurality of transverse grid component receiving areas, thereby providing an integrated grid.

Further embodiments from that set forth in the preceding paragraph may be provides, such as: wherein the integrated grid is a lighting grid; further wherein the grid is one of an air register grid and an air register screen; further comprising trimming out portions of the grid from the integrated grid to conform to a desired shape; and/or further wherein the plurality of transverse grid components in the second grid component framework include a plurality of longitudinal grid component receiving areas which correspond to the plurality of longitudinal grid components. Other and further embodiments or aspects from these additional embodiments may be wherein: it further comprises providing the integrated grid with an outer tab portion outside of the grid, the outer tab portion being configured to engage a lighting fixture and thereby secure the integrated tab to the lighting fixture; and/or further comprising providing the integrated grid with an outer tab portion outside of the grid, the outer tab portion being configured to engage an object to which it is to be attached and to thereby secure the integrated tab to the object.

In another embodiment, a method for assembling a grid with a plurality of longitudinal and transverse components is provided, the method comprising: providing a first grid component blank; imposing a cut pattern on the first grid component blank, the cut pattern defining a plurality of longitudinal grid components and a plurality of transverse grid component receiving areas on the longitudinal grid components, thereby defining a first grid component framework; bending the plurality of longitudinal grid components to an approximately perpendicular relation to the first grid component blank; providing a second grid component blank; imposing a cut pattern on the second grid component blank, the cut pattern defining a plurality of longitudinal grid components, and thereby defining a second grid component framework; bending the plurality of longitudinal grid components to an approximately perpendicular relation to the second grid component blank; and inserting the second grid component framework into the first grid component framework such that the plurality of transverse grid components are inserted into the plurality of transverse grid component receiving areas.

Additional or further embodiments to that disclosed in the preceding paragraph, may: be further comprised of applying an insertion force sufficient to render the first grid component framework and the second grid component framework an integral grid; and/or further comprising trimming outer portions of the integrated grid to conform to a desired shape. Other and further embodiments or aspects from these additional embodiments may be: further wherein the integral grid is a light louver grid; and/or further comprising providing the integrated grid with an outer tab portion outside of a grid area, the outer tab portion being configured to engage an object to which it is to be attached and to thereby secure the integrated tab to the object.

In yet another embodiment, a method for assembling a light louver grid with a plurality of longitudinal and transverse components, the method comprising: providing a first grid component blank; imposing a cut pattern on the first grid component blank, the cut pattern defining a plurality of longitudinal grid components and a plurality of transverse grid component receiving areas on the longitudinal grid components, thereby defining a first grid component framework; bending the plurality of longitudinal grid components to form a plurality of light louvers in an approximately perpendicular relation to the first grid component blank; providing a second grid component blank; imposing a cut pattern on the second grid component blank, the cut pattern defining a plurality of longitudinal grid components, and thereby defining a second grid component framework; bending the plurality of longitudinal grid components to form a plurality of light louvers in an approximately perpendicular relation to the second grid component blank; inserting the second grid component framework into the first grid component framework such that the plurality of transverse grid components are inserted into the plurality of transverse grid component receiving areas; and wherein a plurality of longitudinal and a plurality of transverse light louvers are operatively attached to one another to form a light louver grid.

In still yet another embodiment of the invention, a lighting louver grid component is provided which is comprised of: a one piece first louver workpiece which includes a plurality of longitudinal grid components connected to and bent approximately perpendicular to a common framework, each of the plurality of longitudinal grid components includes a plurality of transverse grid component receiving areas configured to receive a plurality of transverse grid components. In a further embodiment of the foregoing, a lighting louver grid component may be further comprised of: a one piece second louver workpiece which includes a plurality of transverse grid components connected to and bent approximately perpendicular to a common framework, each of the plurality of transverse grid components including a plurality of longitudinal grid component receiving areas configured to receive the plurality of longitudinal grid components of the first louver workpiece; and wherein the first louver workpiece is operatively attached to the second louver workpiece, thereby defining a lighting louver grid.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A method for assembling a grid with a plurality of longitudinal and transverse components, the method comprising:

providing a first grid component blank;

imposing a cut pattern on the first grid component blank, the cut pattern defining a plurality of longitudinal grid components and a plurality of transverse grid component receiving areas on the longitudinal grid components, thereby defining a first grid component framework;

bending the plurality of longitudinal grid components to an approximately perpendicular relation to the first grid component blank;

providing a second grid component blank;

imposing a cut pattern on the second grid component blank, the cut pattern defining a plurality of transverse grid components, and thereby defining a second grid component framework;

bending the plurality of transverse grid components to an approximately perpendicular relation to the second grid component blank; and inserting the second grid component framework into the first grid component framework such that the plurality of transverse grid components are inserted into the plurality of transverse grid component receiving areas.

2. A method for assembling a grid as recited in claim 1, and further comprising applying an insertion force sufficient to render the first grid component framework and the second grid component framework an integral grid.

3. A method for assembling a grid as recited in claim 2, and further wherein the integral grid is a light louver grid.

4. A method for assembling a grid as recited in claim 1, and further comprising trimming outer portions of the integrated grid to conform to a desired shape.

5. A method for assembling a grid as recited in claim 4, and further comprising providing the integrated grid with an outer tab portion outside of a grid area, the outer tab portion being configured to engage an object to which it is to be attached and to thereby secure the integrated tab to the object.

6. A method for assembling a light louver grid with a plurality of longitudinal and transverse components, the method comprising:

providing a first grid component blank;

imposing a cut pattern on the first grid component blank, the cut pattern defining a plurality of longitudinal grid components and a plurality of transverse grid component receiving areas on the transverse grid components, thereby defining a first grid component framework;

bending the plurality of transverse grid components to form a plurality of light louvers in an approximately perpendicular relation to the first grid component blank;

providing a second grid component blank;

imposing a cut pattern on the second grid component blank, the cut pattern defining a plurality of longitudinal grid components, and thereby defining a second grid component framework;

bending the plurality of longitudinal grid components to form a plurality of light louvers in an approximately perpendicular relation to the second grid component blank;

inserting the second grid component framework into the first grid component framework such that a plurality of transverse grid components are inserted into the plurality of transverse grid component receiving areas; and wherein a plurality of longitudinal and a plurality of transverse light louvers are operatively attached to one another to form a light louver grid.

* * * * *